US009969936B2

(12) United States Patent
Streitenberger

(10) Patent No.: US 9,969,936 B2
(45) Date of Patent: May 15, 2018

(54) ROTARTY THERMOLYSIS REACTOR AND METHOD FOR OPERATING SAME

(71) Applicant: Hartwig Streitenberger, Golmsdorf (DE)

(72) Inventor: Hartwig Streitenberger, Golmsdorf (DE)

(73) Assignee: HS TechTransfer UG (haftungsbeschraenkt) & Co. KG, Jena (DE)

( * ) Notice: Subject to any disclaimer, the term of this patent is extended or adjusted under 35 U.S.C. 154(b) by 258 days.

(21) Appl. No.: 14/649,742

(22) PCT Filed: Dec. 1, 2013

(86) PCT No.: PCT/DE2013/000783
§ 371 (c)(1),
(2) Date: Jun. 4, 2015

(87) PCT Pub. No.: WO2014/086334
PCT Pub. Date: Jun. 12, 2014

(65) Prior Publication Data

US 2015/0322347 A1 Nov. 12, 2015

(30) Foreign Application Priority Data

Dec. 4, 2012 (DE) ..... 10 2012 024 204

(51) Int. Cl.
*C10B 7/00* (2006.01)
*C10B 7/10* (2006.01)
(Continued)

(52) U.S. Cl.
CPC ..... *C10B 7/00* (2013.01); *C10B 1/10* (2013.01); *C10B 7/10* (2013.01); *C10B 49/02* (2013.01); *C10B 53/00* (2013.01); *C10J 3/007* (2013.01)

(58) Field of Classification Search
CPC ..... C10B 49/02; C10B 1/10; C10J 3/007
See application file for complete search history.

(56) References Cited

U.S. PATENT DOCUMENTS 4,123,332 A 10/1978 Rotter
4,140,478 A 2/1979 Kawakami et al.
(Continued)

FOREIGN PATENT DOCUMENTS

DE 26 37 558 3/1977
DE 27 25 650 12/1977
(Continued)

*Primary Examiner* — Jonathan Miller
(74) *Attorney, Agent, or Firm* — Norris McLaughlin & Marcus, P.A.

(57) ABSTRACT

The invention relates to apparatus in the form of a rotary thermolysis reactor and a method for operating the reactor for the thermal decomposition of by-products and waste. The reactor includes a tubular outer jacket with covers closing its ends, an interior chamber, a shaft mounted centrally in the covers, feed devices and discharge devices which are placed at the start and the end of the shaft, respectively, inside an interior chamber, wherein helical coil runners are fixed to the shaft and gasification agents are applied to the material being thermolyzed, via gasification shafts in the lower section of the tubular outer jacket.

17 Claims, 3 Drawing Sheets

(51) Int. Cl.

| | |
|---|---|
| ***C10B 1/10*** | (2006.01) |
| ***C10B 49/02*** | (2006.01) |
| ***C10B 53/00*** | (2006.01) |
| *C10J 3/00* | (2006.01) |

(56) References Cited

U.S. PATENT DOCUMENTS

| | | | | |
|---|---|---|---|---|
| 4,205,919 | A | 6/1980 | Attwell | |
| 4,522,648 | A * | 6/1985 | Kunicki | B01D 53/1468 75/501 |
| 4,591,362 | A | 5/1986 | Yudovich et al. | |
| 8,306,665 | B2 * | 11/2012 | Tsangaris | C03B 5/005 422/105 |
| 8,323,369 | B2 * | 12/2012 | Robertson | C10B 47/44 202/117 |
| 8,366,882 | B2 * | 2/2013 | Rinker | C10G 1/00 201/17 |
| 8,377,155 | B2 * | 2/2013 | Tyer | C10J 3/30 201/31 |
| 8,808,510 | B2 * | 8/2014 | Jeswine | C10B 49/14 202/219 |
| 2008/0147241 | A1 * | 6/2008 | Tsangaris | C03B 5/005 700/273 |
| 2008/0172941 | A1 * | 7/2008 | Jancker | C10J 3/485 48/73 |
| 2009/0205252 | A1 * | 8/2009 | Tyer | C10J 3/30 48/76 |
| 2010/0032279 | A1 * | 2/2010 | Robertson | C10B 47/44 202/222 |
| 2014/0090298 | A1 * | 4/2014 | Rakshit | F23G 5/027 48/101 |

FOREIGN PATENT DOCUMENTS

| | | |
|---|---|---|
| DE | 28 29 749 | 3/1979 |
| DE | 31 26 049 | 1/1983 |
| DE | 196 14 689 | 10/1997 |
| DE | 199 32 822 | 1/2001 |
| DE | 199 34 070 | 4/2001 |
| DE | 10 2008 058 602 | 6/2010 |
| DE | 10 2009 007 768 | 8/2010 |
| WO | WO-00/17288 | 3/2000 |
| WO | WO-2009/130523 | 10/2009 |
| WO | WO-2010/096038 | 8/2010 |

* cited by examiner

ROTARTY THERMOLYSIS REACTOR AND METHOD FOR OPERATING SAME

BACKGROUND OF THE INVENTION

The invention relates to a device in the form of a rotary thermolysis reactor and a method for operating a reactor of this kind in an arrangement for the thermal decomposition of by-products and waste.

DE 10 2008 058 602 A1 describes a moving-bed gasifier which comprises a carburetor chamber with a carburetor free space and a carburetor base, with the carburetor free space being surrounded by a carburetor jacket, and at its one, closed end it has a synthesis gas outlet and by its second, open end it is connected via the carburetor jacket with the carburetor base.

The interior of the carburetor base is designed as a carburetor pot into which a feed unit and at least one supply duct lead.

The carburetor pot comprises a recessed bottom opposite to the carburetor chamber that ends in a central chute.

Furthermore, according to DE 10 2008 058 602 A1 agitators are provided which are rotatably mounted in the carburetor pot by an agitator shaft that is surrounded by a delivery device. The carburetor pot encloses with the carburetor jacket an isolation chamber through which the feed unit, the supply duct, the central chute and the agitator shaft with conveyor device, which is supported by the carburetor base jacket, are guided.

In the carburetor chamber, a carburetor dome is provided in such a manner that a gap is generated between the carburetor dome and the carburetor jacket and/or the carburetor pot.

DE 10 2009 007 768.5 discloses a thermolysis reactor with an outer jacket and an inner jacket that form a double jacket, with the inner jacket being surrounded by the outer jacket so that a gap is generated between the inner jacket and the outer jacket; the double jacket comprises a feed unit, a discharge unit, at least one gasifying agent inlet and a distributing unit, and the inner jacket encloses an interior chamber with covers closing its ends.

The gap is closed to the environment at the ends of the double jacket formed by the inner jacket and the outer jacket, the covers support a shaft with a heat carrier located in the gap and the shaft, and the shaft is centrally mounted in the covers and carries a conveying device.

According to DE 10 2009 007 768.5, this thermolysis reactor is used for carrying out a method in which the thermolysis reactor is placed in an inclined position so that the discharge device is located above the feed device.

The shaft is driven and a heated liquid heat transfer medium is produced and moved in the shaft and the double jacket.

This liquid heat transfer medium is passed by way of the guide-flow in the gap, and the material to be treated is guided by the conveyor device from the feed device to the discharge device and heated by means of a supplied gasifying agent during this transport.

This technical solution has the disadvantage that no forced transport of the material to be treated in the reactor is organized, the existing firebed of the thermolysis reaction is destroyed and thus blockages in the reactor and slag and separate pockets of embers are produced.

Therefore, these reactors and methods do not ensure a stable and uniform process management. As a result of the instable and nonuniform process management, the supply of energy via the gasifying agent is no longer distributed in terms of quality and quantity, thus leading to partial overheating and burning and consequently to a stop of the pyrolytic process.

Since the transport flow of the material in the reactor is not forced and is partially impeded by the conveyor in the form of agitator devices (paddle or helical devices) the firebed is destroyed or separated and leads to process-cumbersome "hotspots".

Thus, the gasifying agent escapes without flowing through the material and thus causes a thermochemical reaction stop. A continuous and stable temperature-controlled process management is not possible any longer. The process stops.

This unstable process management not only causes the stop of the entire pyrolysis process, but also local overheating and thus the distortion of the thermolysis chamber.

Regardless of the extremely fluctuating gas quality, the thermochemical reduction of the material is not completed and therefore adverse process conditions for/of subsequent arrangements are produced.

DE 199 32 822 A1 and DE 196 14 689 A1 disclose conveyor devices for reactors in the form of a conveyor screw or a transport screw. These conveyors also have the disadvantages described above.

SUMMARY OF THE INVENTION

The object of the present invention is to specify a device in the form of a rotary thermolysis reactor which overcomes the disadvantages of the state of the art, i.e. particularly organizes a forced transport of the material to be treated in the reactor, does not destroy the existing firebed of the thermolysis reaction and thus prevents blockages in the reactor and the production of slag and separate pockets of embers to ensure a stable and uniform management of the thermolysis process.

The essence of the invention is that the rotary thermolysis reactor is principally comprised of a tubular outer jacket with covers closing its ends, an interior chamber, a shaft mounted centrally in the covers, feed devices and discharge devices which are placed at the start and the end, respectively, of the shaft inside the interior chamber, and helical coil runners fixed to the shaft.

The shaft is moved by a drive unit, a material inlet is provided vertically directly above the feed devices and a material outlet is placed vertically directly below the discharge devices.

Furthermore, at least one, preferably two perforated gasification hollow shafts are arranged axially and centrally in the lower section of the rotary thermolysis reactor.

Moreover, preferably, separate gasifying agent inlets, a gas discharge mounted laterally in the upper feed area, two valves arranged centrally and above the outer jacket, pressure relief units and various gauge ports are installed into the reactor wall.

In this system, the rotary thermolysis reactor is horizontally supported on a frame.

This rotary thermolysis reactor is operated in such a manner that the material discharge unit is positioned at the opposite end below the material feed unit, the shaft is externally driven by a drive unit, the material to be treated is mixed and dispersed by feed devices, then transported axially and radially by the coil runners, and a gasifying agent, preferably hot air and added oxygen to initialize exothermic and endothermic processes, is supplied to the material flow via the gasifying agent inlets and/or gasification shafts.

Due to the action of the coil runners close to the inner side of the tubular outer jacket in the interior chamber, the material, that is converted to thermolysis coke by charring during the process, is compulsorily lifted by an axial and radial pulse, dispersed and transported in a continuous-undulated manner towards the discharge devices and material discharge unit.

In this procedure, the gasifying agent passes, under slight negative pressure and without interruption and destruction of the firebed, only through the material flow.

BRIEF DESCRIPTION OF THE DRAWINGS

In the following, the invention is explained in more detail by means of the schematic drawings and the embodiments. The figures show.

DETAILED DESCRIPTION OF THE INVENTION

Figure 1:
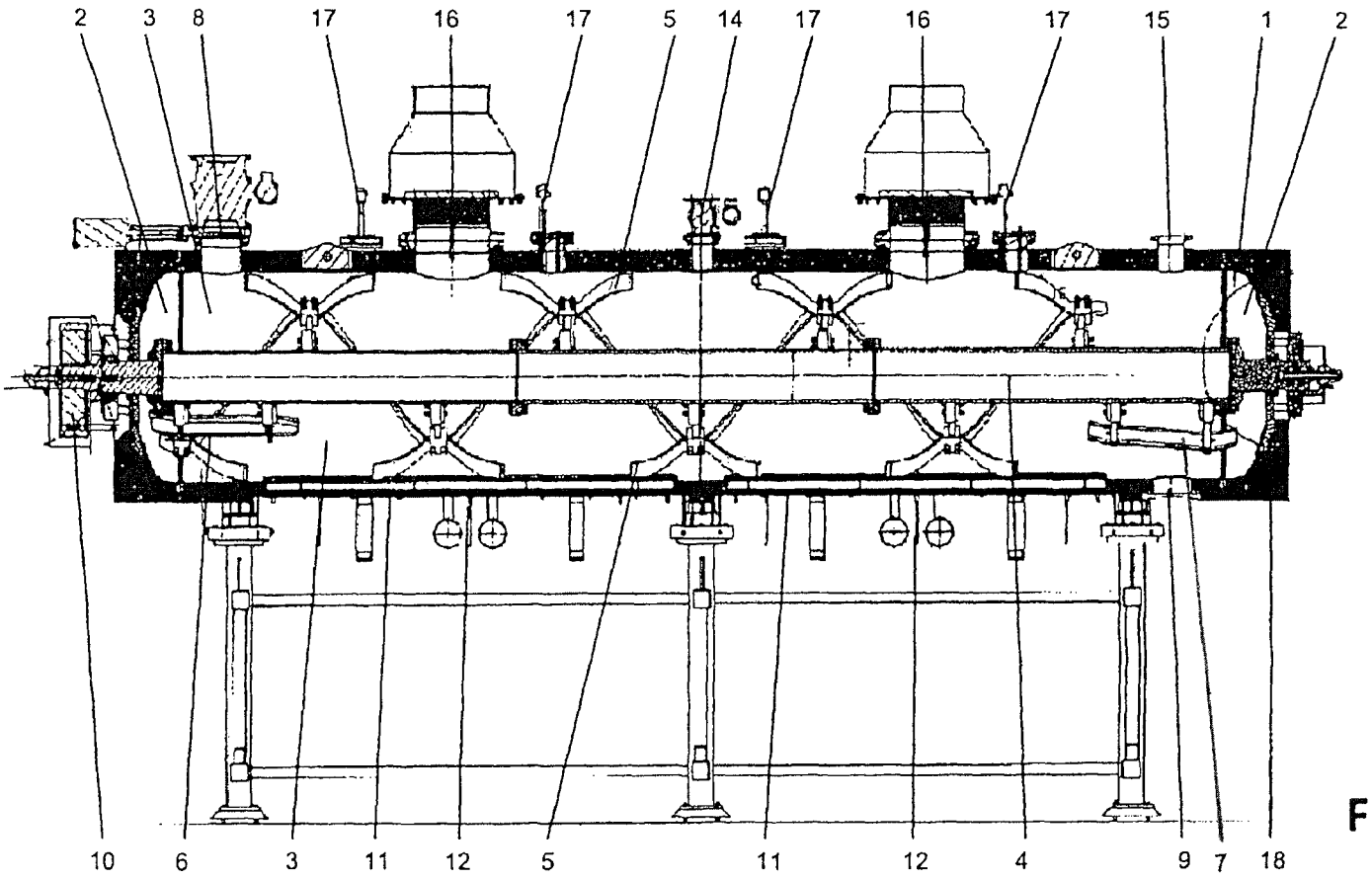
FIG. 1: a schematic drawing of one embodiment of an inventive rotary thermolysis reactor.
Figure 2:
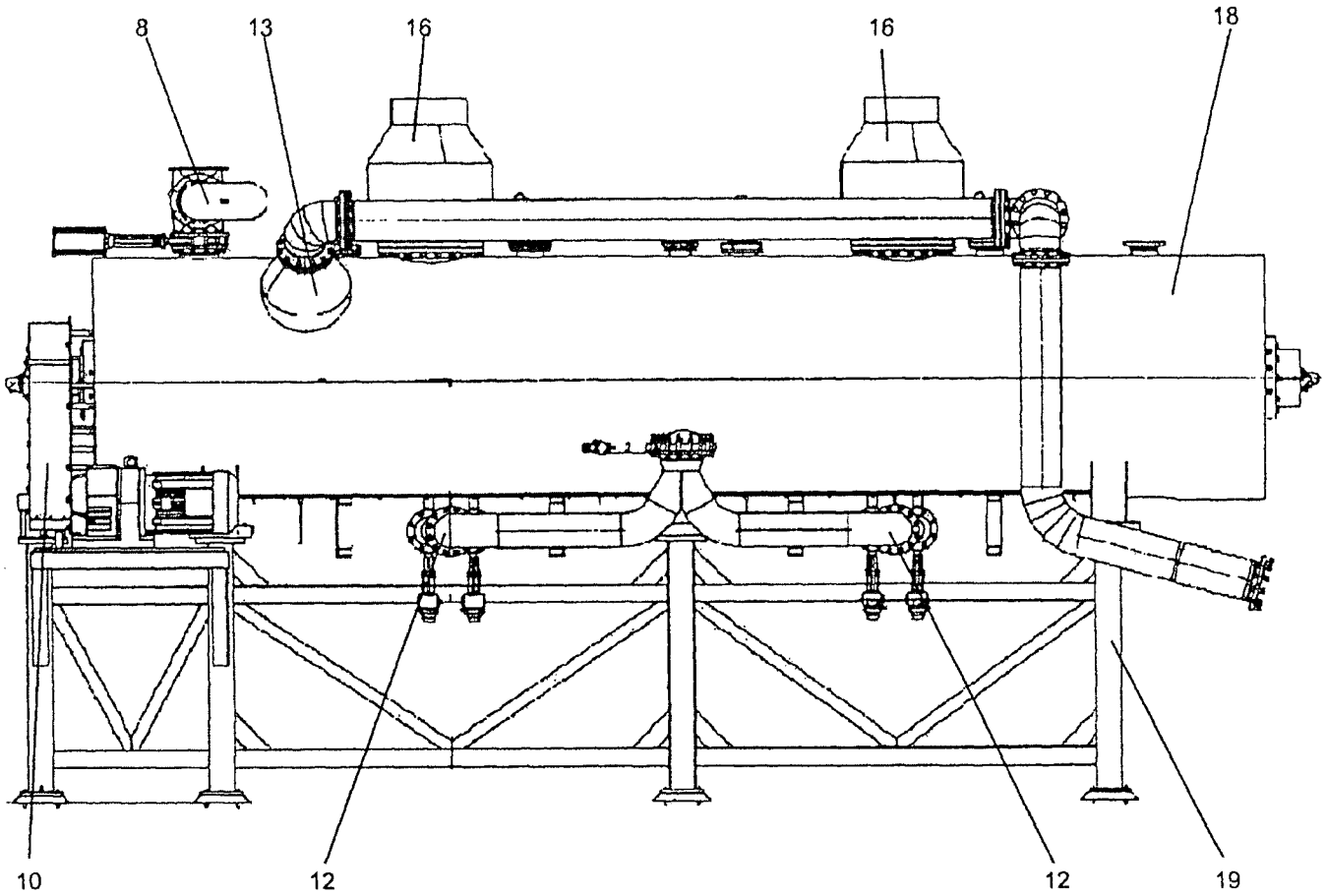
FIG. 2: a schematic drawing of the lateral view of the rotary thermolysis reactor according to FIG. 1, and FIG. 3: a schematic drawing of a cross-section of the inventive rotary thermolysis reactor according to FIG. 1.
Figure 3:
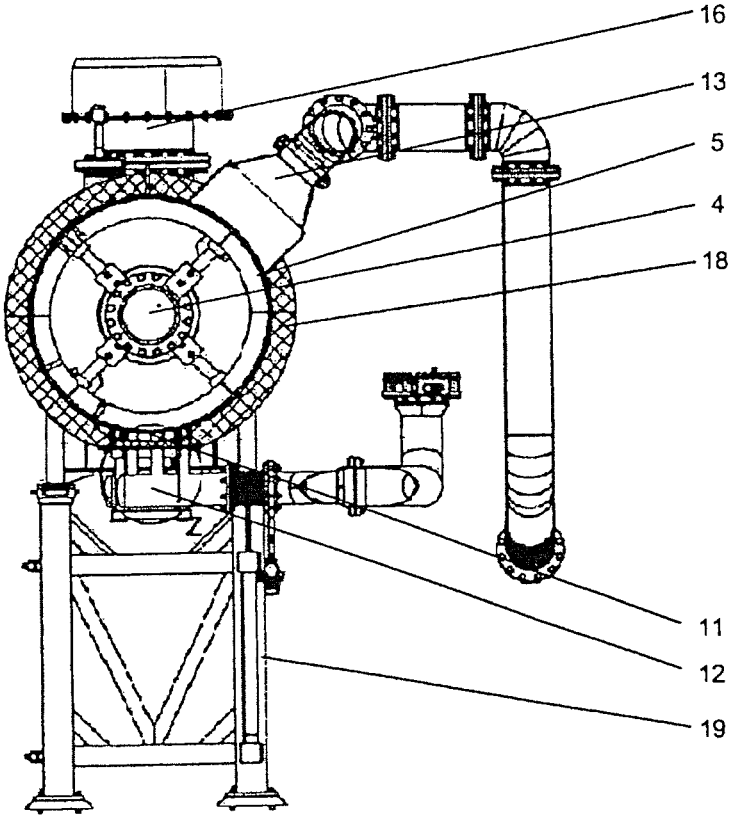

FIG. 1 shows a rotary thermolysis reactor which consists of a tubular outer jacket (1) and in its interior chamber (3) a thermochemical reaction in the form of an auto-thermal degasification (partial oxidation) of the raw material takes place under a slight negative pressure.

Said outer jacket (1) is provided with a cover (2) at each of its two ends that close the interior chamber (3) at both sides and it is surrounded by an insulation (16).

A shaft (4) is mounted centrally in the two covers (2) and helical coil runners (5) are fixed at this shaft (4).

Feed devices (6) and discharge devices (7) are positioned at the start and at the end of the shaft (4), respectively, and can be moved via a drive unit (10).

A material feed unit (8) is provided vertically directly above the feed devices (6) in the wall of the rotating thermolysis reactor, and a material discharge unit is located below the discharge devices (7) in the wall of the reactor.

Furthermore, two perforated gasification shafts (11) are positioned axially and centrally in the lower section of the wall of the rotary thermolysis reactor.

In addition, separate gasifying agent inlets (12) and a gas outlet (13) are guided through the wall of the rotary thermolysis reactor. The gas outlet (13) is mounted laterally in the upper feed section.

A valve A (14) and a valve B (15) are provided centrally and above the outer jacket (1).

Moreover, pressure relief units (16) and various gauge ports (17) are guided through the wall of the rotary thermolysis reactor.

The rotary thermolysis reactor is surrounded by a thermal insulation (18) and is supported horizontally on a frame (19).

A particularly advantageous feature is the spiral-shaped design of the coil runners (5) and their installation, as a single unit or as several units, close to the inner side of the tubular outer jacket (1) in the interior chamber (3) of the rotary thermolysis reactor.

In such an embodiment, the coil runners (5) can have a square, rectangular, round or oval cross-section.

In addition, it is particularly advantageous, if the feed devices (6) are provided within the effective range of the helical coil runners (5) as one unit or as several units parallel to the shaft (4) and below the material feed unit (8).

The feed devices (6) may have a square, rectangular, round or oval shape,

Furthermore, one discharge device (7) is or several of them are fixed above the material discharge unit (9).

The discharge devices (7) may have a square, rectangular, round or oval cross-section.

The gasification shafts (11) have preferably a perforated or slotted design.

The material feed unit (8) is preferably provided with a rotary star valve. The gas outlet (13) of the rotary thermolysis reactor can be placed both in the center and at the end, and the valve A (14) and the valve B (15) are preferably designed as rotary star valves.

In proper operating condition, the rotary thermolysis reactor is preferably placed in a horizontal position on a frame (19).

This rotary thermolysis reactor is operated in the following way:

The solid (selected, crushed, pre-heated and pre-dried) waste products, hereinafter referred to as material, are supplied via the material feed unit (8) into the interior chamber (3) of the rotary thermolysis reactor. The material is supplied in such a way that only very small amounts of ambient air reach the interior chamber (3). For this purpose, a rotary star valve is preferably used.

The interior chamber (3) surrounded by the tubular outer jacket (1) and the laterally closing covers (2) carries the centrally mounted shaft (4) with feed devices (6), coil runners (5) and discharge devices (7), and in operating mode the material is continuously transported by the rotation of the shaft (4) with the coil runners (5), feed devices (6) and discharge devices (7) mounted thereon from the material feed unit (8) to the material discharge unit (9).

During this operation, the shaft (4) is guided centrally in the covers (2) at both the feed and discharge ends and is driven by an external drive unit (10).

The material reaches the rotary thermolysis reactor preferably at a temperature from 50° C. to 100° C., with an edge length of up to 35 mm and a residual moisture content of between 10 and 15 percent by weight. After being supplied, the material is mixed and dispersed by means of the feed devices (6) and supplied to the coil runners (5). By the addition of gasifying agents, preferably air with enriched oxygen, via the gasifying agent inlets and their distribution to the gasification shafts (11) installed in the lower section, the material flow is guided into the interior chamber (3) of the rotary thermolysis reactor.

Due to the radial rotation of the coil runners (4) close to the inner side of the tubular outer jacket (1) in the interior chamber (3), the material is lifted, dispersed and transported towards the material discharge unit (9) by a compelling axial and radial pulse In this procedure, the gasifying agent passes through only the material flow and leads to targeted endothermic and exothermic reactions. The exothermic processes provide the energy for the endothermic processes. The continuous undulating material flow prevents interruptions, the destruction of the firebed, nest formations and hotspots. Free gasifying agent does not enter the upper section of the interior chamber (3) of the rotary thermolysis reactor.

The produced reaction gas passes through the material flow, i.e., the reaction material, upwards into the free interior chamber (3) and is in part carried away by the gas outlet (13) and fed back into the reactor proximate the feed end of the reactor for the thermolysis of more material. Separately from this process, the produced thermolysis coke is led out via the material discharge unit (10) or fed back into the interior chamber (3) to admix with the material therein.

The material is dried out by the heat supplied by the gasifying agent and then pyrolyzed. A portion of the gases released during this thermal process react with the gasifying agent and thus they produce a part of the required process heat.

According to the invention, the gasifying agent is metered so that the targeted carbonization of the material takes place. This is preferably done at temperatures from 350 to 550° C. After the overall process, the entire material has been converted to carbon-containing solid particles and hydrocarbon process gas. These solid and gaseous components are led out through the material discharge unit (9).

To stabilize the process conditions, in particular the energy demand of the exothermic process, additional carbon, preferably coming from the previously pyrolyzed material, is supplied via a valve A (14). Another valve (15) allows the addition of additives, preferably lime, to bond harmful substances.

The pressure relief unit (16) installed in the upper part of the tubular outer jacket (1) is used for pressure relief in case of overpressure. To ensure process control, gauge ports (17) are installed, preferably in axial arrangement, in the tubular outer jacket (1) for receiving sensors.

In order to stabilize the process temperature, the entire rotary thermolysis reactor is thermally insulated by an insulation (18) and mounted on a frame (19) which permits a linear extension caused by thermal expansion.

The main advantages of the inventive rotary thermolysis reactor are that it allows the organization of a uniform and forced transport of the material to be treated in the reactor, that the existing firebed of the thermolysis reaction is not destroyed and that blockages in the reactor and slag and separate pockets of embers are prevented to ensure a stable and uniform control of the thermolysis process.

In particular, the continuous undulated material flow prevents interruptions, the destruction of the firebed, nest formations and hotspots.

All features disclosed in the embodiments and the subsequent claims can be important for the invention both individually and in any combination with each other.

The invention claimed is:

1. A rotary thermolysis reactor, comprising;

a tubular outer jacket with covers closing ends thereof, the respective ends being proximate to respective feed and discharge areas of the reactor, an interior chamber within the outer jacket, a shaft supported centrally in the covers, a device configured for feeding and a device configured for discharging are mounted on the shaft at feed and discharge ends, respectively, of the shaft inside the interior chamber, helical coil runners fixed to the shaft, a drive for rotating the shaft and therewith the devices configured for feeding and discharging and the helical runners, and a feed unit configured to feed into the interior chamber material to be thermolyzed by the thermolysis reactor, wherein the device configured for feeding is mounted on the shaft within effective range of the helical coil runners and vertically directly below the feed unit.

2. The rotary thermolysis reactor according to claim 1, wherein the helical coil runners have a spiral configuration and are arranged, as one unit or as a plurality of units, close to a cylindrical wall of the interior chamber defined by an inner wall of the exterior jacket and have a square, rectangular, round or oval cross-section.

3. The rotary thermolysis reactor according to claim 2, wherein the device configured for feeding is arranged as one unit or as a plurality of units and the device configured for discharging is arranged as one unit or as a plurality of units and wherein the devices configured for feeding or discharging have a square, rectangular, round or oval cross-section, and the device configured for discharging is located directly above a material discharge unit.

4. The rotary thermolysis reactor according to claim 3, wherein the material feed unit and the material discharge unit are installed in a wall of the cylindrical outer jacket.

5. The rotary thermolysis reactor according to claim 4, further comprising two perforated or slotted gasification shafts arranged parallel to an axis of the outer jacket in a lower part of a wall of the outer jacket with the perforations or slots opening into the interior chamber.

6. The rotary thermolysis reactor according to claim 5, wherein separate gasifying agent inlets and a gas outlet pass through the wall of the outer jacket, and the gas outlet is arranged laterally in an upper part of a feed area.

7. The rotary thermolysis reactor according to claim 6, wherein a first valve and a second valve are provided centrally and above the outer jacket, and pressure relief units and gauge ports pass through a wall of the outer jacket.

8. The rotary thermolysis reactor according to claim 1, wherein the outer jacket is surrounded by thermal insulation and supported horizontally on a frame.

9. The rotary thermolysis reactor according to claim 8, wherein the material feed unit is provided with a rotary star valve, and the first valve and the second valve are configured as rotary star valves.

10. A method for operating the rotary thermolysis reactor of claim 7, comprising supplying material to be treated into the feed unit proximate an end of the thermolysis reactor and discharging thermolysis end products at the discharge unit proximate an opposite end of the rotary thermolysis reactor, and wherein the shaft is driven by the drive unit, the material to be treated is mixed and dispersed by the device configured for feeding, then axially and radially transported by the action of the helical coil runners in the interior chamber, a gasifying agent, to initialize exothermic and endothermic processes, is supplied to a flow of the material via the gasifying agent inlets and the gasification shafts, the material is lifted by a driving axial and radial pulse of the helical coil runners close to the inner walls of the tubular outer jacket in the interior chamber to be dispersed and transported in a continuous and undulating movement towards the device configured for discharge and the discharge unit, and the gasifying agent passes at a slight negative pressure only through the material flow and without interruption and destruction of a firebed in the interior chamber.

11. The method according to claim 10, wherein the gasifying agent is pre-heated to a temperature of up to 500° C. and supplied via at least one of the gasifying agent inlets and/or at least one of the gasification shafts below the material.

12. The method according to claim 11, wherein carbon is supplied via the first valve to stabilize energy demand of an exothermic process occurring in the reactor, and additives are added via the second valve to bond harmful substances, and process gas generated in the reactor is, in part, taken up by the gas outlet and fed back into the feed area of the reactor for treatment of more material.

13. The method according to claim 10, wherein thermolysis in the reactor is a thermochemical reaction in a form of an auto-thermal degasification with partial oxidation of the material.

14. The method according to claim 10, wherein the gasifying agent is hot air with added oxygen.

15. The method according to claim 12, wherein the additives comprise lime.

16. The rotary thermolysis reactor according to claim 1, wherein walls of the interior chamber, the shaft and the helical coil runners are configured such that the coil runners are proximate the walls of the interior chamber throughout rotation of the shaft and the material in the interior chamber is conveyed in the reactor by axial and radial pulses applied by the coil runners.

17. The rotary thermolysis reactor according to claim 1, wherein walls of the interior chamber, the shaft and the helical coil runners are configured such that the coil runners are proximate the walls of the interior chamber throughout rotation of the shaft and the material in the interior chamber is conveyed in the reactor only by axial and radial pulses applied by the coil runners.

* * * * *